United States Patent [19]

Vago

[11] Patent Number: 4,791,888

[45] Date of Patent: Dec. 20, 1988

[54] WATER HEATER TANK CONSTRUCTION

[75] Inventor: Otto Z. Vago, Burns, Tenn.

[73] Assignee: State Industries, Inc., Ashland City, Tenn.

[21] Appl. No.: 95,434

[22] Filed: Sep. 11, 1987

[51] Int. Cl.[4] ..... F22B 5/00

[52] U.S. Cl. ..... 122/17; 122/14; 122/19; 126/361

[58] Field of Search ..... 122/13, 17, 14, 19; 126/361

[56] References Cited

U.S. PATENT DOCUMENTS

| | | | |
|---|---|---|---|
| 2,322,488 | 6/1943 | Uecker | 122/17 |
| 2,401,151 | 5/1946 | Haberstump | 122/17 X |
| 4,394,848 | 7/1983 | Siebelt | 122/13 R |

*Primary Examiner*—Edward G. Favors

*Attorney, Agent, or Firm*—Fuller, Puerner & Hohenfeldt

[57] ABSTRACT

A water heater tank having a tank shell and a tank top and bottom member welded therein to provide a water tight space inside the shell. A cold water outlet is mounted in the lower portion of the tank. The tank top member has an upwardly extending flange welded to the tank shell. The flange has a deformed portion extending inwardly from the main body of the flange to provide a space between the shell and the deformed portion. The hot water outlet is mounted in the upper portion of the tank with at least a portion of the outlet extending into the space provided by the deformed portion of the flange. The axis of the hot water outlet is thereby positioned at approximately the same level as the face of the tank top member.

2 Claims, 1 Drawing Sheet

WATER HEATER TANK CONSTRUCTION

BACKGROUND OF THE INVENTION

1. Field of the Invention

This invention relates to water heaters and more specifically to a water heater tank construction having a unique hot water outlet design.

2. Description of the Prior Art

In a water heater tank of conventional design the hot water outlet is located in the top portion in the tank as shown in dotted lines in FIG. 1. With such design the water level of the tank provides a relatively large air space above such level in which the exposed portions of the tank interior are subject to corrosion. The design of the present invention contemplates the location of the hot water outlet at a distinctly higher level in the tank to thereby reduce the amount of exposed portions of the tank in the space above the water level.

SUMMARY OF THE INVENTION

A water heater tank including a shell having a tank top member and tank bottom member welded therein. A cold water outlet is mounted in the lower portion of the shell. The tank top member has an upwardly extending flange welded to the tank shell. The flange has a deformed portion extending inwardly from the main body of the flange to provide a space between the shell and the deformed portion. A hot water outlet is mounted in the upper portion of the tank with at least a portion of the outlet extending into the space provided by the deformed portion of the flange to thereby provide a water level in the tank which is substantially higher than that of the conventional design.

DESCRIPTION OF THE PREFERRED EMBODIMENT

Figure 2:
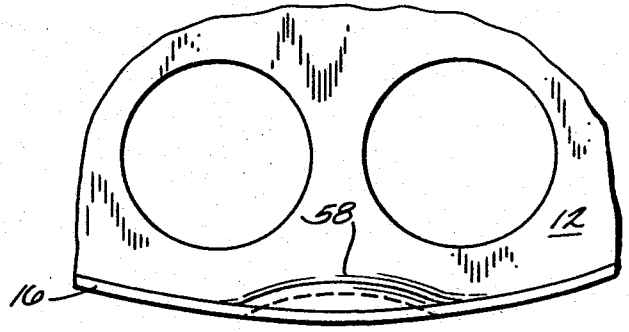
FIG. 2 is a fragmentary top plan view of the tank top member of the water heater shown in FIG. 1.
Figure 3:
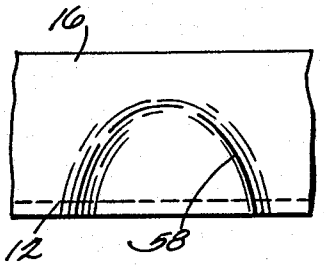
FIG. 3 is a fragmentary side elevation view taken along line 3—3 of FIG. 2.
Figure 1:
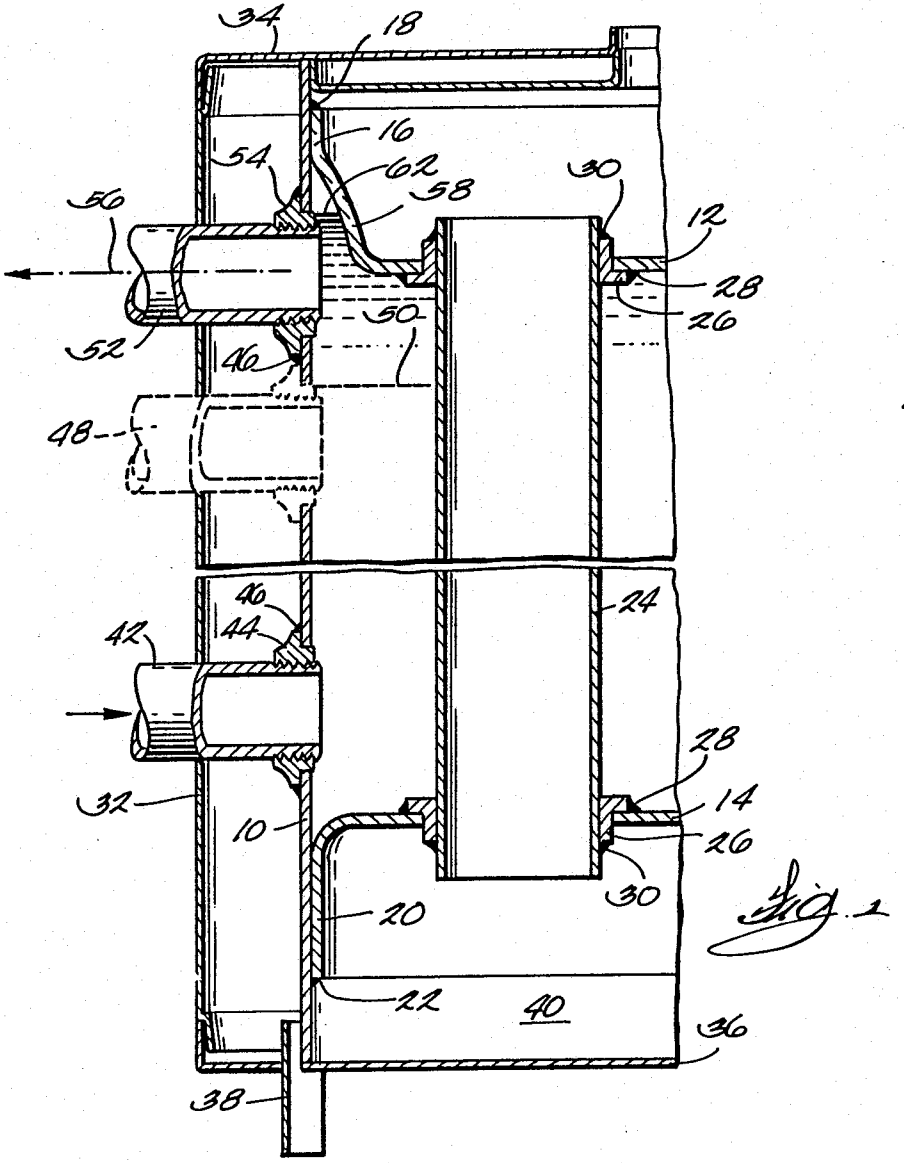
FIG. 1 is a fragmentary cross sectional elevational view of the water heater equipped with an improved hot water outlet construction.

Referring to FIG. 1, the water heater is comprised of a tank shell 10 having a top tank member 12 and a bottom tank member 14 mounted therein. Top and bottom members 12 and 14 are fastened to shell 10 by welds 18 and 22 to provide a water tight space in the tank. Top member 12 has an upwardly extending flange 16 fastened to shell 10 by a weld 18. Tank bottom member 14 has a downwardly extending flange 20 fastened to shell 10 by a weld 22.

A plurality of flue tubes 24 (one shown) are mounted in tank top and bottom members 12 and 14 by means of collar members 26 and welds 28 and 30.

A jacket member 32 is mounted around tank 10 and has a jacket top member 34 and a jacket bottom member 36.

Jacket bottom member is provided with a plurality of legs 38 and the space 40 directly below tank bottom 14 serves as a combustion chamber in which a burner (not shown) is mounted.

Cold water is introduced into the bottom portion of the tank through nipple 42 threaded into a spud 44 of conventional design. Spud 44 is welded to tank shell 10 by weld 46.

In a water heater tank of conventional design the hot water outlet 48 is located in the top portion of the tank as shown in dotted lines in FIG. 1. With such design, the water level in the tank as indicated by reference numeral 50 will provide a relatively large air space above such level in which the exposed portions of the tank interior are subject to corrosion.

The design of the present invention contemplates the location of the hot water outlet at a distinctly higher level in the tank. Such design includes an outlet nipple 52 and spud 54 assembly mounted with the axis 56 of nipple 52 at approximately the same level as the face of tank top member 12. To accommodate such location of the hot water outlet, the flange 16 of the tank member 12 is provided with a deformed portion 58 which extends inwardly from the main body of flange 16 to thereby provide a space 60 between shell 10 and the deformed portion 58 of flange 16. In such improved construction the water level can be maintained at a relatively high level as indicated by reference numeral 62 to thereby materially reduce the air space above level 62 which in turn materially reduces the portions of the tank interior which are exposed to air. Corrosion of the exposed portions of the tank interior is thereby reduced.

I claim:

1. A water heater tank construction comprised of a tank shell having a tank top member and a tank bottom member mounted therein to provide a water tight space therein, a cold water outlet mounted in lower portion of said tank shell, said tank top member having an upwardly extending flange welded to said tank shell, said flange having a deformed portion extending inwardly from the main body of the flange to provide a space between said shell and said deformed portion, and a hot water outlet mounted in the upper portion of said tank shell with at least a portion of said outlet extending into said space provided by said deformed portion of said flange.

2. A water heated according to claim 1 in which the axis of said hot water outlet is at approximately the same level as the face of said tank top member.

* * * * *

UNITED STATES PATENT AND TRADEMARK OFFICE

CERTIFICATE OF CORRECTION

PATENT NO. : 4,791,888

DATED : December 20, 1988

INVENTOR(S) : Otto Z. Vago

It is certified that error appears in the above—identified patent and that said Letters Patent is hereby corrected as shown below:

Column 2, Line 54

Delete "heated" and substitute therefor
--- heater ---

Signed and Sealed this

Twenty-third Day of May, 1989

*Attest:*

DONALD J. QUIGG

*Attesting Officer*

*Commissioner of Patents and Trademarks*